United States Patent [19]

Bergmann et al.

[11] Patent Number: 4,881,596

[45] Date of Patent: Nov. 21, 1989

[54] HEAT EXCHANGE PIPE FOR HEAT TRANSFER

[76] Inventors: Gyorgy Bergmann, Karpat u. 40, Budapest 1133; Gabor Csaba, 1021 Tosojato ut 100/b, Budapest II; Géza Hivessy, 1151 Platau u. 4, Budapest XV, all of Hungary

[21] Appl. No.: 339,893

[22] Filed: Apr. 17, 1989

Related U.S. Application Data

[63] Continuation of Ser. No. 40,638, Apr. 21, 1988, abandoned.

[30] Foreign Application Priority Data

Apr. 21, 1986 [HU] Hungary ..... 1648/86

[51] Int. Cl.[4] ..... F28F 9/02; F15D 1/06

[52] U.S. Cl. ..... 165/174; 165/177; 138/38

[58] Field of Search ..... 165/174, 177; 138/38; 366/336, 338

[56] References Cited

U.S. PATENT DOCUMENTS

| | | | |
|---|---|---|---|
| 2,335,687 | 11/1943 | Modine | 165/174 X |
| 2,929,408 | 3/1960 | Weatherwax et al. | 138/38 |
| 3,470,912 | 10/1969 | Bydal | 366/388 X |
| 4,208,136 | 6/1980 | King | 366/338 |
| 4,407,269 | 10/1983 | Hopper | 165/174 X |
| 4,577,681 | 3/1986 | Hughes | 165/109.1 |

FOREIGN PATENT DOCUMENTS

| | | | |
|---|---|---|---|
| 982549 | 1/1976 | Canada | 366/338 |
| 1401669 | 10/1968 | Fed. Rep. of Germany | 165/174 |
| 1389508 | 9/1972 | United Kingdom | 366/338 |

*Primary Examiner*—Ira S. Lazarus
*Assistant Examiner*—Peggy Neils
*Attorney, Agent, or Firm*—Michael N. Meller

[57] ABSTRACT

A heat exchange pipe for heat transfer between a medium in the pipe (1) and another medium outside the pipe (1) including baffle elements (3) for deflecting a layer of the first medium in the pipe (1). According to the improvement in this invention, each baffle element (3) has two kinds of deflecting channels, an inlet opening of the first kind of which is in a well defined first portion of a cross-section of the pipe (1) and its outlet is in a well defined second portion of the cross-section, and an inlet opening of the second kind of deflecting channels is in the second portion and its outlet is in the first portion of the cross-section.

10 Claims, 8 Drawing Sheets

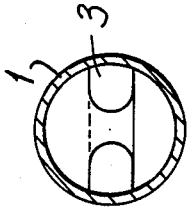
FIG. 1
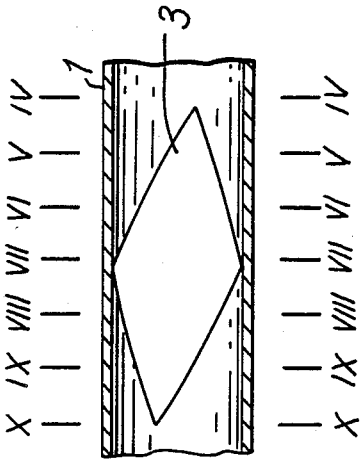
FIG. 2
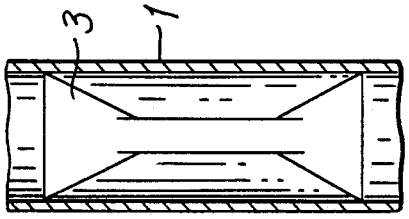
FIG. 3
FIG. 4
FIG. 5
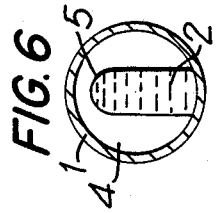
FIG. 6
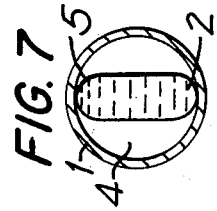
FIG. 7
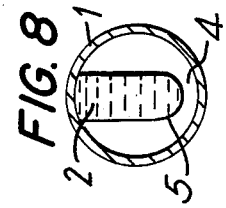
FIG. 8
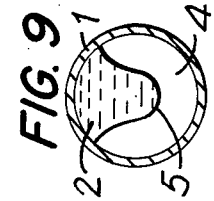
FIG. 9
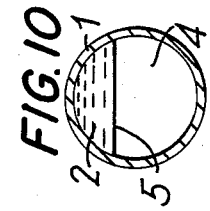
FIG. 10

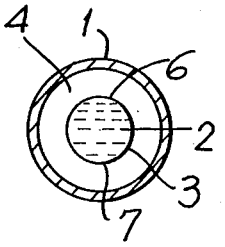
FIG. 11
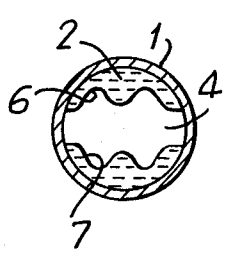
FIG. 12
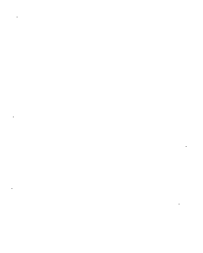
FIG. 13
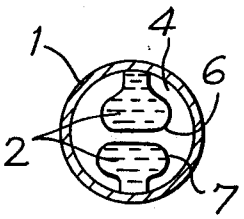
FIG. 14
FIG. 15
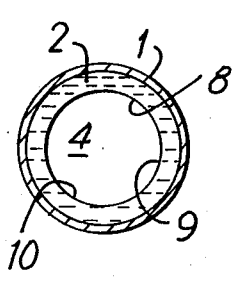
FIG. 16
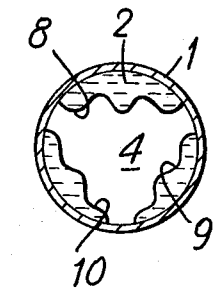
FIG. 17
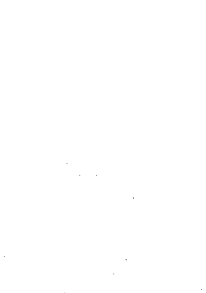
FIG. 18
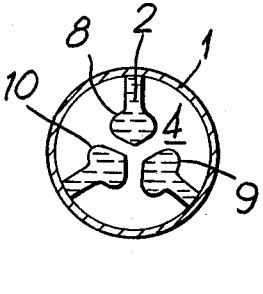
FIG. 19
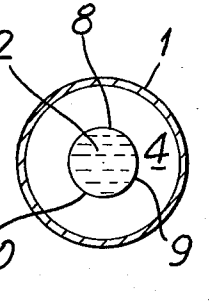
FIG. 20

HEAT EXCHANGE PIPE FOR HEAT TRANSFER

This application is a continuation, of application Ser. No. 040638, filed 4/21/87 now abandoned.

FIELD OF THE INVENTION

The invention relates to heat exchange pipes for heat transfer between a medium in the pipe and another medium outside the piipe including baffle elements for deflecting a layer of the first medium in the pipe.

BACKGROUND OF THE INVENTION

It is a well known fact that heat transfer is quite difficult when the agents to be cooled have an inhomogeneous composition in cross-sectional direction of the heat exchange pipe. This is the case with agents composed of two different components or having two different phases such as gas and liquid. It is also well known that these agents have in most cases a wavy flow pattern or a ring-shaped flow pattern within the pipe. In the first case, the liquid phase flows in a lower part of the pipe and has a wavy free surface within the pipe, and the gas or vapor streams above this wavy surface. In the latter case, the liquid phase adheres in a ring from the inner wall of the pipe and encircles the gas or vapor streaming in the middle of the pipie. In both cases, the two phases don't stream together but they occupy two "flow channels" separate from each other.

This kind of agent is to be re-cooled in many fileds of the industry. In the case of heat pumps or of refrigerators, the agents to be cooled comprise a mixture of two components having different volatilities. These two phases differ not only in their states but in their concentrations, too. When the working agent having two phases is cooled, its temperature gets lower and, at the same time, dissolving and condensation occur. Since the two phases stream separately, they are not in a constant thermodynamic equilibrium and, therefore the component which is less volatile condensates quicker, the condensate recools quicker, and the component which is more volatile and forms the larger part of the gaseous phase dissolves later in the liquid phase. As a result, the temperature characteristics of the known heat exchange pipes dependent on the amount of heat transferred are quite disadvantageous. Thus, for a given thermodynamic process, a larger and more expensive heat/exchanger is required for providing the same thermodynamic coefficiency.

The same problems arise when the working agent in the pipe is warmed by a hotter outer agent such as water. Since the two components of the working agent get separated, the amount of heat which can be transferred is smaller than what is theoretically attainable.

In the operation of the known heat exchange pipes, a further disadvantageous effect can also be observed which arises with working agents having only one component. In a condenser, for example, the already condensed working agent forms a liquid phase which remains on the inner surface of the pipe wall, forming a resistance to the heat transfer between the non-condensed steam phase and the wall of the pipe.

It has also been found that the above-mentioned ring-shaped flow pattern is quite similar to that of the viscous liquids used as working elements in heat exchange pipes. In the first case, the composition of the agent itself is inhomogeneous, and in the latter, the physical conditions (temperature and viscosity) are inhomogeneous to a great extent.

It is a well known fact that, for example, oils which are used for the lubrication of the bearings of steam turbines or gas turbines and cooling thereof and which are cooled in heat exchangers to extract the heat arising from the mechanical heat losses from the bearings, are bad heat conductors and flow laminary in the pipes of the heat exchangers.

As a consequence of said properties, the heat transfer coefficient of the oils is low, having the disadvantageous consequence that cooling requires large and expensive heat exchangers.

The inferior heat transfer coefficient of laminar flowing oils with poor heat conductivity can be explained by the fact that the outer layer, having been cooled and flowing with a low velocity along the pipe surface, is acting as thermal insulation and hinders the path of the heat flux from the warmer oil towards the pipe wall. While the outer cooled oil is flowing forwards with a low velocity on the pipewall, forming a quasi denser layer on the pipewall, the warm oil flows in the middle of the pipe where it is hardly cooled. Heat is able to flow only by way of conductivity.

According to the practice developed earlier, longitudinally arranged inner ribs are used, which are parallel or substantially parallel to the longitudinal axis of the pipe. Essentially, the heat has to travel a shorter path in the cut-up cross section, accordingly resistance will be also less. However, the drawback of the ribs lies in that resistance, weight and therefore cost of production of the heat exchanger are also increased.

To lessen the effect of the aforementioned disadvantageous features, a heat exchange pipe for heat transfer from a medium in the pipe was proposed which includes spaced-apart baffle elements disposed within the pipe substantially perpendicularly to the longitudinal axis of the pipe and which have means for deflecting the outer layer of the medium away from the wall of the pipe. This is described in GB-PS 2 135 439.

While this solution can be regarded as the most developed one in the state of the art, a few disadvantageous features still deteriorate the efficiency of the heat exchangers. The known baffle element has a ring surface which is perpendicular to the wall which has to aid the deflecting action. But this ring surface causes a sharp break in the flow direction, which increases the flow resistance within the pipe and, at the same time, amplifies the tendency of the viscous liquid to by-pass the hindrance, i.e. the ring surface being in its flow path, without any substantial change in its laminar flow pattern in the boundary layer. Nevertheless, the known baffle element can only be used with said viscous liquids within certain speed and viscosity limits. It is not suitable for wavy flow patterns at all.

SUMMARY OF THE INVENTION

The main object of this invention is to eliminate the above-mentioned deficiencies and to provide a heat exchange pipe for increasing the efficiency of the heat transfer between a working agent of practically any kind with wavy flow pattern as well as with a ring-shaped one and an outer agent.

The main idea of the invention is that a baffle element should be used within the pipe with which particles of the working agent having eminent importance with respect to the heat transfer coefficiency should be transferred to a well-defined portion of the pipe when seenin cross section of the pipe. Further, the baffle element should be free of any sharp changes of the flow direction and it should be easy to manufacture and arrange within the pipe.

According to this invention, we propse a heat exchange pipe for heat transfer between a medium in the pipe and another medium outside the pipe including baffle elements for deflecting a layer of the first medium in the pipe, wherein each baffle element has two kinds of deflecting channels: an inlet opening the first kind of which is in a well-defined first portion of the cross section of the pipe and its outlet which is in a well-defined second portion of the cross section, and an inlet opening of the second kind of deflecting channels which is in the second portion and its outlet which is in the first portion of the cross section.

In a preferred embodiment of this invention a surface area of the inlet of the first kind of channels equals that of their outlet.

It is a preferred embodiment of the invention, wherein the deflecting channels of the baffle elements are free of any sharp directional change and have a constant curvature between the inlets and the outlets of the channels. It is also preferred that the first portion of the cross section be limited by the wall and a secant of the cross section of the pipe and the second portion be limited by the wall and by another secant of the cross section. Therein the first portion and the second portion are arranged in diametrically opposite positions and the secants are parallel to each other.

In another preferred embodiment of the invention the first portion of its cross section is substantially ring-shaped and is partially limited by the wall of the pipe. With this, it is possible that the second portion of its cross section has a disk-like shape and is arranged in a middle axis of the pipe, or that the second portion of its cross section is prism-shaped, a middle axis of which coincides with a symmetry line of the cross section In the latter case, the second portion can be limited at least partially by the wall of the pipe.

In a preferred embodiment of this invention more than one baffle element are arranged in the pipe, and the angular dispositions and/or the constructions of the successive baffle elements are different. In all embodiments, the baffle elements can be made of metal plates, preferably by pressing. With this, it is possible in this invention that the baffle elements are assembled from at least two metal plates which are previously formed by pressing to have identical shapes.

According to the invention, it is preferred that the baffle elements be resiliently pressed against the inner wall of the pipe when arranged therein. The baffle elements can always be attached to a fixing wire which is fixed to the pipe.

For the baffle element it is preferable that a length of the baffle element measured in the direction of the longitudinal axis of the pipe be maximally three times greater than the diameter of the pipe. Finally, in a preferred realization a thickness of the metal plate material of the baffle elements is maximally one tenth of the diameter of the pipe.

Further objects and details of this invention will be described hereinafter with reference to the accompanying drawing on the basis of preferred embodiments. In the drawing FIG. 1 shows a first embodiment of the heat exchange pipe in this invention in cross section, FIG. 2 and FIG. 3 illustrate side elevational views of the embodiment in FIG. 2 from two different directions when the pipe is cut away, FIG. 4 to FIG. 10 show a sequence of cross section as indicated by lines IV to X in FIG. 2, FIG. 11 to FIG. 15 show the same sequence of cross sections as in FIGS. 11 to 15 but for another preferred embodiment of this invention, FIG. 16 to FIG. 20 show the same illustration as in FIGS. 11 to 15 but for still another embodiment of this invention, FIG. 21 shows a further preferred embodiment of the invention.

FIG. 22 and

FIG. 23 show side elevational views of the embodiment in FIG. 21 from two different directions when the pipe is cut away, FIG. 24 to FIG. 29 illustrate a sequence of cross sections as indicated by lines XXIV to XXIX in FIG. 22, FIG. 30 shows still another embodiment of this invention in cross section, FIG. 31 and FIG. 32 illustrate side elevational views of the embodiment in FIG. 30 from two different directions when the pipe is cut away, FIG. 33 to FIG. 38 show a sequence of cross sections as indicated by lines XXXIII to XXXVIII in FIG. 31, finally FIG. 39 to FIG. 44 show a similar sequence of cross sections as in FIGS. 33 to 38 but for another embodiment of this invention.

FIG. 45 shows the manner in which the insert is fixed inside the pipe.

DETAILED DESCRIPTION OF THE PREFERRED EMBODIMENTS

Figure 22:
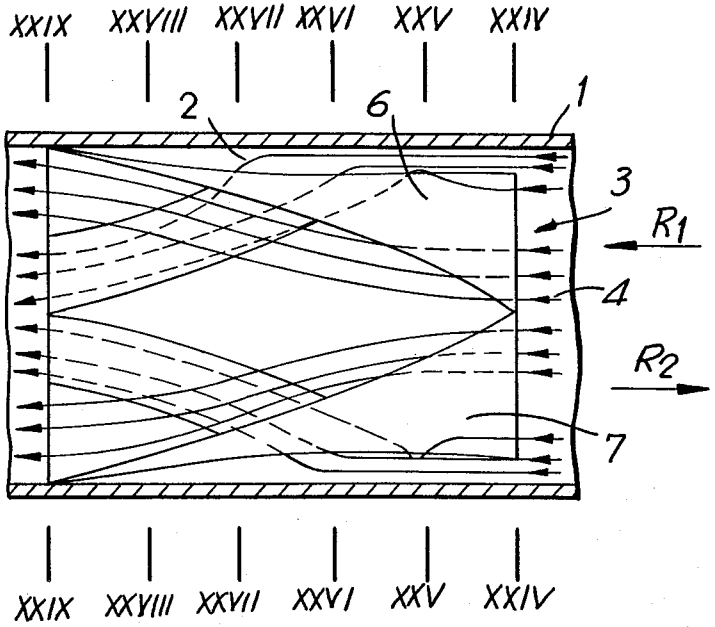
Figure 21:
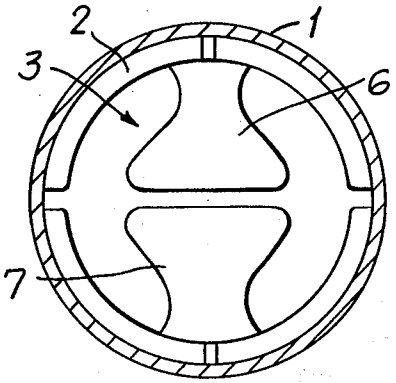
Figure 23:
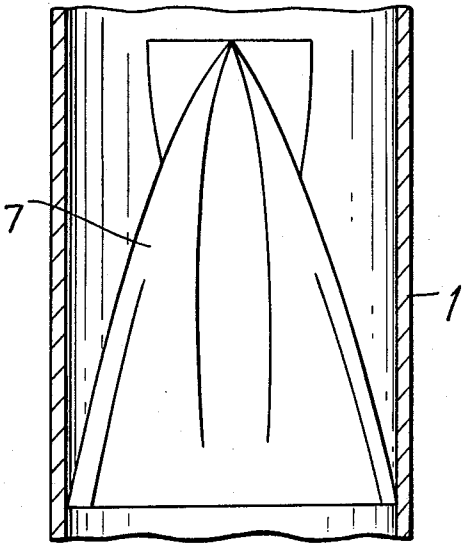
Figure 26:
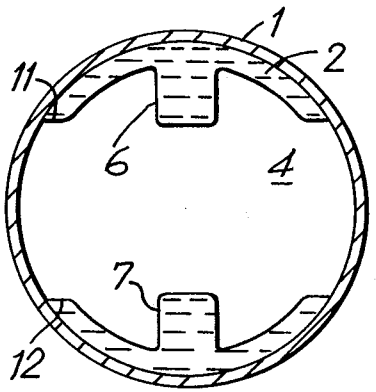
Figure 25:
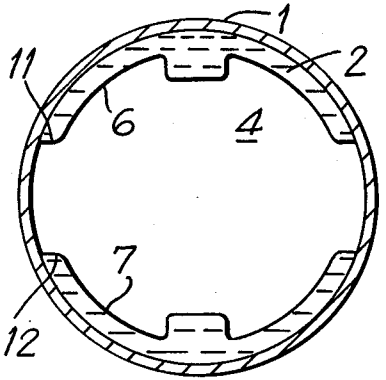
Figure 24:
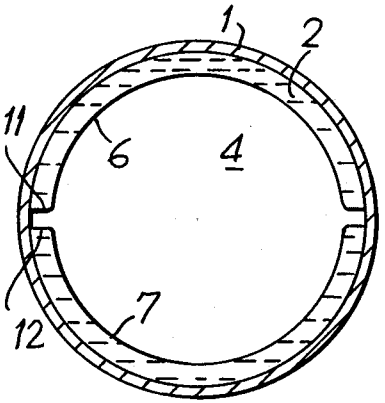

Referring now to the drawings in more detail, FIGS. 1 to 10 illustrate a first preferred embodiment of the heat exchange pipe 1 in this invention. This exemplary embodiment can preferably be used with working agents which or the liquid phase of which have a wavy flow pattern. This liquid phase is referred to by reference numeral 2 throughout the whole description. In pipe 1, a baffle element 3 is arranged, which is shown in FIGS. 4 to 10 always by a line showing the deflecting surface which is cut by the cutting plane generating the cross sections. With this baffle element 3, liquid phase 2 is lifted from a lower part of the cross section of pipe 1 in FIG. 4 to a higher part of it in FIG. 10. Baffle element 3 as shown in FIG. 4 is formed for exactly separating liquid phase 2 from a gaseous or steam phase 4 of the working agent streaming in pipe 1. In this way, liquid phase 2 and gaseous or steam phase 4 as shown in FIG. 4 correspond to an inlet of two separated channels of baffle element 3. In the lower one defined by the wall of pipe 1 and the deflecting surface of baffle element 3, liquid phase 2 is forwarded and in the upper one defined by the other side of the deflecting surface of baffle element 3 and the remaining part of the wall of pipe 1 the gaseous or steam phase 4 is forwarded. With this, a first kind of channel for liquid phase 2 and a second kind of channel for gaseous or steam phase 4 are provided in baffle element 3.

The form of the channels in the respective cross sections according to lines IV to X in FIG. 2 can be followed in FIGS. 4 to 10. It is apparent that the deflecting surfaces determining the channels have streamlined shapes. Thus, the phases do not suffer from any sharp change in direction of their flow. Throughout the whole path within the baffle element 3, each of phases 2 and 4 is in a closed channel, respectively. The outlets of the channels are shown in FIG. 10, that of liquid phase 2 in a higher portion of the cross section than the height of which the inlet of the channel of gaseous or steam phase 4 (FIG. 4) is, and that of gaseous or steam portion 4 in a lower portion of the cross section, in the height of which the inlet of the channel for liquid phase 2 (FIG. 4) is. In this way, the liquid phase 2 is in its whole amount separated from the wall of pipe 1 and it changes places with the gaseous or steam phase 4. At the outlet, liquid phase 2 is again in contact with the inner wall of pipe 1 (see FIGS. 8 to 10).

In the above described embodiment, heat exchange pipe 1 has a circular cross section, wherein the deflecting surfaces at the inlet and the outlet of the channels are formed as secants of the circle which are parallel to each other. The cross-sectional areas determined by the secants and the inner wall of the pipe 1 for the channel of liquid phase 2 are equal at the inlet and at the outlet, respectively. In another embodiment, the cross-sectional area of the outlet of the channel of the liquid phase 2 can be greater than the inlet and, with this, a continuously narrowing channel can be provided for the gaseous or steam phase 4. Thus, the speed of this phase 4 will be increased and the liquid phase 2 will be sucked on the outlet side of baffle element 3. This arrangement is very useful in applications wherein the liquid phase 2 has a relatively low streaming speed and the energy for its "lifting" must additionally be provided. Although, the latter embodiment increases the flow resistance, it could be necessary.

In FIGS. 11 to 15, the same secquence of cross sections are shown as with the previous embodiment, however, this embodiment can be used for the ring-shaped flow pattern, in the case where the liquid phase 2 is adhered to the wall of pipe 1 in a ring form. This embodiment differs from the previous one in that, too, the channels are formed of two deflecting surfaces 6 and 7 which define a ring-shaped inlet opening, two separated deflecting channels and an outlet opening in the center of pipe 1 for the liquid phase 2. The inlet of the channel for phase 4 is in the center of pipe 1, the deflecting channel is defined by deflecting surfaces 6 and 7 and the outlet is ring-shaped around the outlet of liquid phase 2.

In FIGS. 16 to 20 another embodiment is shown for the same application. Therein, three deflecting surfaces 8, 9 and 10 are circumferentially distributed at 120 degrees with respect to each other. They define three channels for liquid phase 2 having a common ring-shaped inlet and a common outlet in the center of pipe 1.

Figure 29:
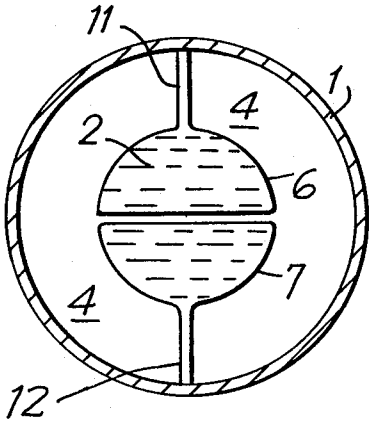
Figure 28:
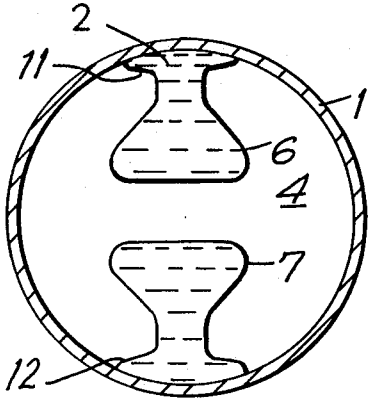
Figure 27:
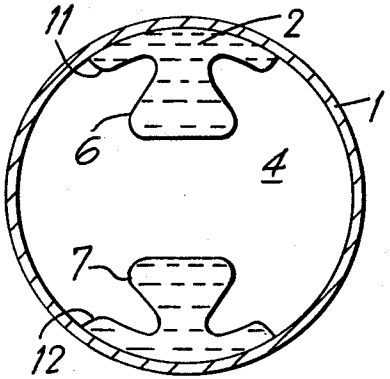
Figure 31:
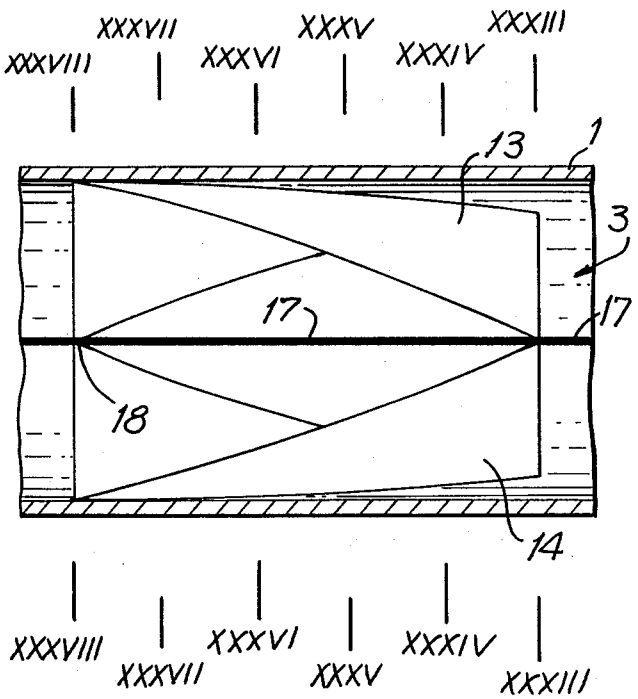
Figure 30:
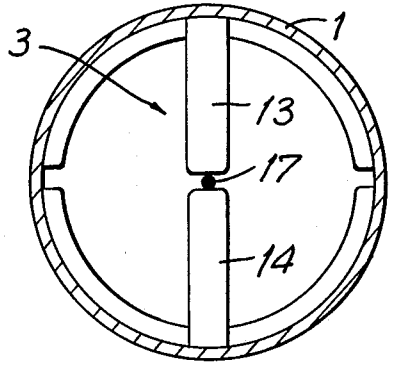
Figure 32:
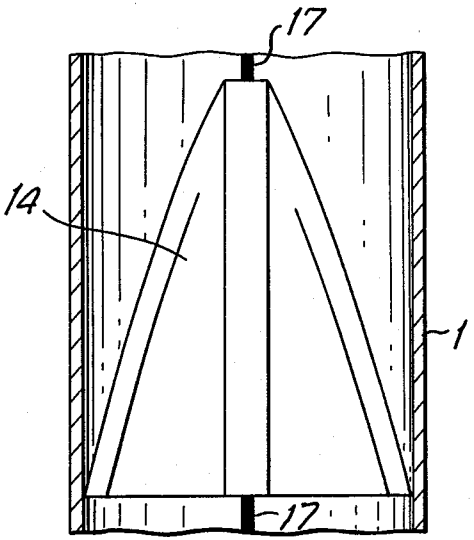
Figure 35:
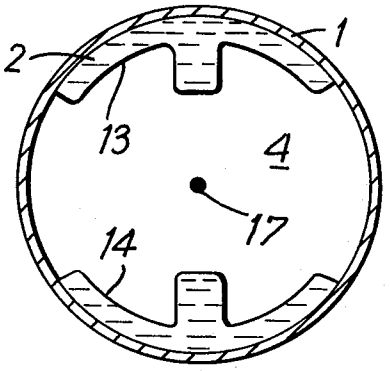
Figure 34:
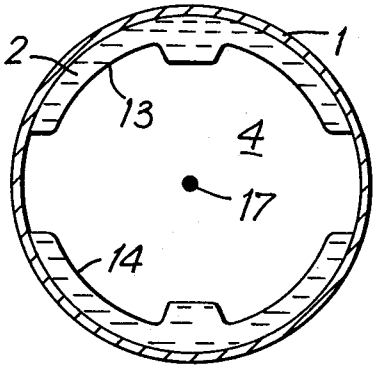
Figure 33:
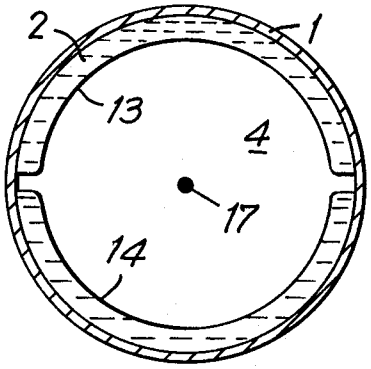

Whereas in the previous figures theoretically realizable possiblities of the heat exchange pipe 1 of this invention were shown, FIGS. 21 to 29 illustrate an embodiment which is easy to manufacture. This embodiment corresponds to that shown in FIGS. 11 to 15 wherein baffle element 3 has two deflecting surfaces 6 and 7 which are formed, in this example, of metal sheets by pressing. Deflecting surfaces 6 and 7 have identical shapes and are arranged in a face-to-face relationship. They define two channels for liquid phase 2 between the ring-shaped inlet and the outlet in the center of pipe 1. Edges 11 and 12 of deflecting surfaces 6 and 7 lie against the wall of pipe 1 along the whole length of baffle element 3. Edges 12 contact the pipewall in a tight relationship, so that the liquid phase 2 having the ring-shaped flow pattern can only enter its channels between the wall of pipe 1 and deflecting surfaces 6 and 7. It will leave them at the outlet of the channels defined by deflecting surfaces 6 and 7 in the center of pipe 1 as shown in FIG. 29. At the outlet, edges 11 of deflecting surface 6 and edges 12 of deflecting surface 7 are tightly connected to each other, respectively. In this way, the boundary layer of liquid phase 2 will be completely separated from the wall of pipe 1 and led through the channels into the center of pipe 1. At the same time, gaseous or steam phase 4 streaming in the middle of pipe 1 enters its channel in FIG. 24 and leaves it at the outlet in ring form around deflecting surfaces 6 and 7 as shown in FIG. 29. With this, the total change of places of phases 2 and 4 will occur with the aid of baffle element 3.

Since edges 11 and 12 contact the wall of pipe 1 along the whole length, baffle element 3 can be fixed within the pipe 1 with the aid of the resilient force of deflecting surfaces 6 and 7. For this, baffle element 3 must be made for having a bigger diameter than the actual diameter of pipe 1 and it will be slightly compressed when arranging it within the pipe. The resilient force of the metal sheet material of baffle element 3 will fix it in the pipe 1.

Figure 45:
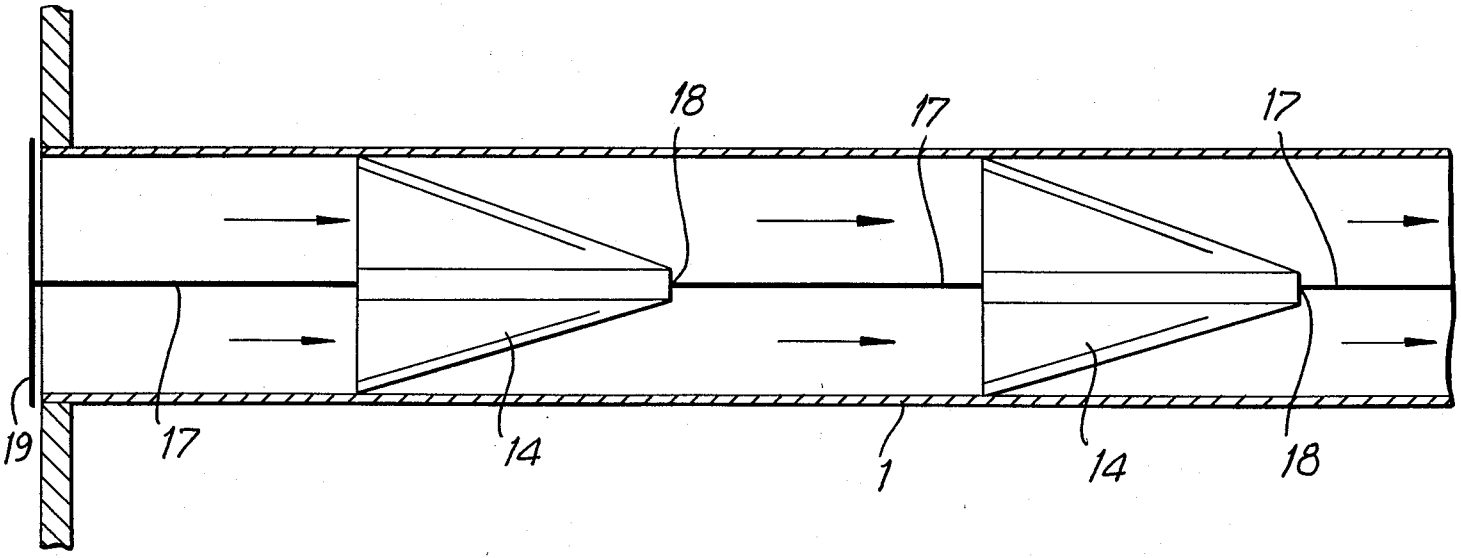

However, a fixing wire can also be used for fixing the axial position of baffle elements 3 in pipe 1. This fixing wire (shown in FIG. 45) can be attached to deflecting surfaces 6 and 7 between edges 11 and 12.

In FIG. 22, stream lines of phases 2 and 4 are shown for a flow direction $R_1$. Of course, baffle element 3 can be operated with opposite flow direction $R_2$, too, only the cross sectional ratios have to be determined according to the actual flow direction.

Figure 38:
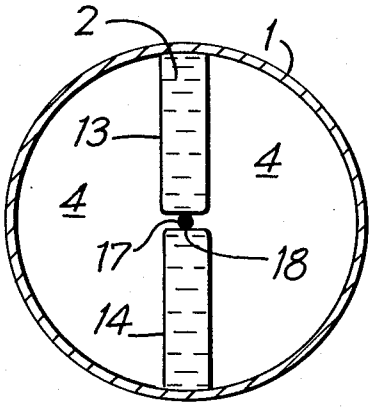
Figure 37:
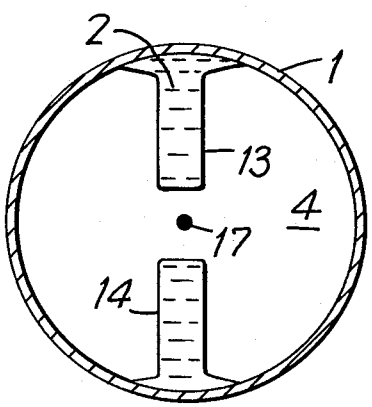
Figure 36:
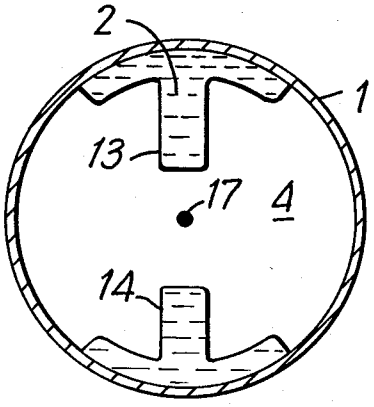
Figure 41:
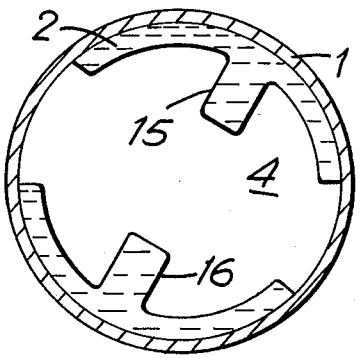
Figure 40:
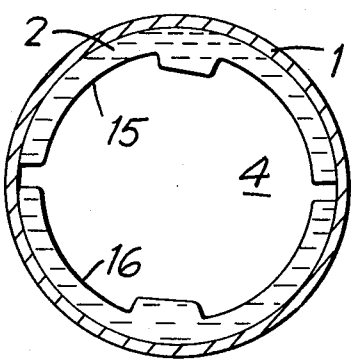
Figure 39:
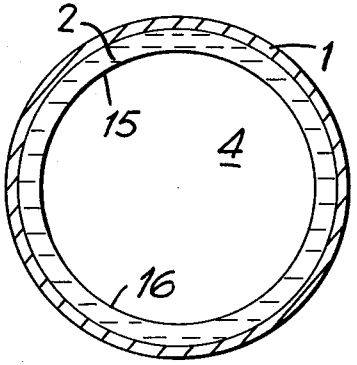
Figure 44:
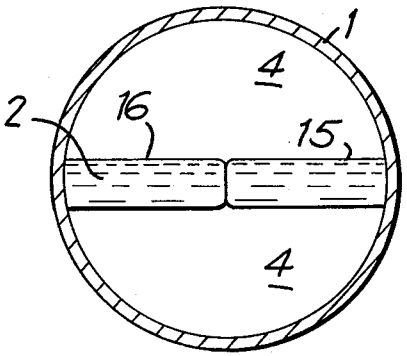
Figure 43:
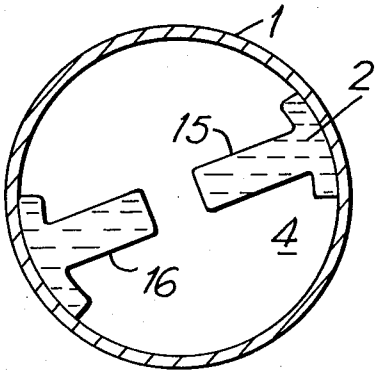
Figure 42:
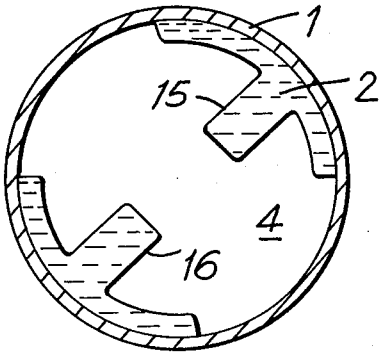

In FIGS. 30 to 38, a simpler embodiment with the same theoretical construction as in FIGS. 11 to 15 is shown which is easier to manufacture. However, liquid phase 2 does not depart from the inner wall of pipe 1 along the whole diameter, since the channels of this embodiment defined by deflecting surfaces 13 and 14 are not closed in themselves but they are partly limited by the wall of pipe 1 along the whole baffle element 3. Thus, the outlets of the channels of liquid phase 2 have prismatic shapes, respectively, as shown in FIG. 38. The form of channels of phases 2 and 4 and, in this way, the shape of deflecting surfaces 13 and 14 are much simpler than in the previous embodiments which reduces costs of the production. Liquid phase 2, which does not depart from the wall of pipe 1 with this baffle element 3, can be led away with the next baffle element 3 having the same construction but being arranged in pipe 1 for having the outlets of channels of liquid phase 2 twisted 90 degrees with respect tot hat of the baffle element 3 before it. With this, portions of liquid phase 2 remaining at the wall of pipe 1 after the first baffle element 3 will be removed from the wall by the next baffle element 3, since these portions will fall right into the middle of the inlets of the channels for liquid phase 2.

As is mentioned above, the embodiments shown in FIGS. 4 to 10 are suitable for wavy flow pattern and the embodiments in the further figures for ring-shaped flow patterns. However, it often occurs that, because of the changing operational conditions, the flow pattern is sometimes wavy, sometimes a ring-shaped one. Therefore, the baffle elements 3 for the two kinds of flow patterns should alternately be arranged in pipe 1. However, an embodiment of the baffle element 3 can also be provided which is effective for both kinds of flow patterns. This exemplary embodiment is shown in FIGS. 39 to 44.

This embodiment differs from the previous one shown in FIGS. 30 to 38 in that the outlet of the channels for liquid phase 2 is twisted by 90 degrees with respect to the outlet of these channels in the previous embodiment. In this way, deflecting surfaces 15 and 16 forming the channels provide a spiral-like path for liquid phase 2. It is apparent, that the boundary layer of liquid phase 2 will be removed from the wall of ppe 1 and, at the same time, liquid phase 2 having a wavy flow pattern will be lifted into the height of the middle line and, simultaneously, it will get a drift, too. This drift of lifted liquid 2 promotes its further lifting motion.

Nevertheless, the embodiment shown in FIGS. 39 to 44 can further be twisted, e.g. by 180 degrees, too. With this, the drift of liquid phase 2 can be made greater. It is also possible to use two of the baffle elements shown in these figures tightly one after the other to provide this greater drift of liquid phase 2.

As shown in the drawings, baffle elements 3 are mostly, not longer than three times the diameter of pipe 1. Deflecting surfaces 5 to 10 and 13 to 16 are relatively thin, usually one hundredth of the diameter of pipe 1 but not more than one tenth of it. As mentioned already, the cross-sectional area of the channels is usually constant throughout the whole length of baffle elements 3, however, channels with narrowing or widening cross-sectional area can be advantageous, too. The flow resistance is the smallest with the channels having constant cross section. A widening channel for liquid portion 2 can be useful for the recooling of viscous liquids, since the gaseous or steam phase 4 having an ever-increasing speed will suck liquid phase 2 at the outlet side of the baffle element 3. In contrast to this, a narrowing channel for liquid portion 2 is preferred for heating a viscous liquid within the heat exchange pipe 1, since, in these applications, the boundary layer is hotter, thus, the channels thereof should be narrowed.

It will be apparent from what has been said hereinabove that the described embodiments are only some examples with respect to the possible realization of this invention. One of the important advantages lies in the variability of the heat exchange pipe of this invention with the aid of which an optimal heat exchanger can be provided for all working agents and all heat transfer requirements.

What is claimed is:

1. An insert usable in a heat exchange pipe for improving heat transfer in inhomogeneous media which flow in the pipe, said insert having a beginning, a middle, an end and a longitudinal length which is equal to 1–3 times the diameter of the pipe and comprising a continuous partition-wall part formed from sheet material, wherein the thickness of said partition-wall part is on the order of one-tenth to one-hundredth of the pipie diameter, and the surface of said partition-wall part situated along the flow is a three-dimensional surface having continuous curvature without any sharp changes of direction; whereby along the length of said insert, in place of a single-flow channel of the pipe, there are established at least two channels, completely separated from one another by the walls forming the insert, the walls bounding said channels being formed by said partition-wall part and by the wall of the pipe, the average radial distance of the flowing medium in at least one channel from the axis of the pipe being continuously variable from the beginning of the insert until the end of the insert.

2. An insert in accordance with claim 1, wherein between the wall of the pipe and the partition-wall part there are situated channels of first and second types, the shortest distance between the channel of the first type and the axis of the pipe at the beginning of the insert being not less than one-third of the inner radius of the pipe, while at the end of the insert it is not greater than the thickness of the partition wall and any other structural material that may be used, as a result of which the portion between the channel and the axis of the pipe has a closed flow cross section, and the shortest distance between the channel of the second type and the axis of the pipe at the beginning of the insert being not greater than the thickness of the partition-wall part and any other structural material that may be used while at the end of the insert this distance is not less than one-third of the inner radius of the pipe.

3. An insert in accordance with claim 2, wherein at the end of the insert the shortest distance between the channel of the first type and the wall of the pipe is not less than three times the thickness of the partition-wall part.

4. An insert in accordance with claim 2, wherein at the end of the insert one of the bounding surfaces of the channel of the first type is formed by the wall of the pipe.

5. An insert in accordance with claim 2, wherein said insert is at least partially wrapped around the axis of the pipe.

6. An insert in accordance with claim 1, wherein the insert is symmetric with respect to a vertical plane passing through the axis of the pipe, first and second types of channels being arranged between the wall of the pipe and the partition-wall part, one bounding surface of the channel of the first type being the lower part of the wall of the pipe at the beginning of the insert while being the upper part of the wall of the pipe at the end of the insert, and one bounding surface of the channel of the second type being the upper part of the wall of the pipe at the beginning of the insert while being the lower part of the wall of the pipe at the end of the insert.

7. An insert in accordance with claim 1, wherein said insert is constructed from at least two flat pieces of metal using means for rigid attachment.

8. An insert in accordance with claim 3, wherein said insert is assembled from two sheet-metal segments, symmetric to each other, each segment occupying half of the cylindrical space inside the pipe, that is to say, a 180° portion of the space around the axis of the pipe; the edges of the two segments being made up of parts having flanged edges which at the beginning of the insert touch each other in first pairings, while at the end of the insert they touch each other in second pairings, whereas in an intermediate portion they are in immediate contact with the cylindrical surface, without any gaps, the line of contact being a helical curve with a rotation angle of 90; the two segments contacting each other at two places at the beginning of the insert and at one place at the end of the insert through an attaching mechanism, there being a gap between the two segments, in the intermediate portions of the insert.

9. An insert in accordance with claim 4, wherein said insert is composed of two segments consisting of parts and having flanged edges which are helical curves with a rotation angle of less than 90°, so that at the end of the insert a gap is formed between said flanged edges.

10. A device for improving heat transfer in inhomogeneous media which in a heat-exchange pipe, said device comprising a series of inserts attached to an elongated element placed in said pipe, each insert being as defined in claim 1.

* * * * *